United States Patent [19]

Morse et al.

[11] 4,208,887

[45] Jun. 24, 1980

[54] SUCTION ACCUMULATOR HAVING HEAT EXCHANGER

[75] Inventors: Robert L. Morse, Adrian, Mich.; Sharon J. Hudson, Jr., Toledo, Ohio

[73] Assignee: Tecumseh Products Company, Tecumseh, Mich.

[21] Appl. No.: 5,140

[22] Filed: Jan. 22, 1979

[51] Int. Cl.[2] ..... F25B 43/00

[52] U.S. Cl. ..... 62/503; 62/513

[58] Field of Search ..... 62/503, 512, 513, 113

[56] References Cited

U.S. PATENT DOCUMENTS

| | | | |
|---|---|---|---|
| 2,270,934 | 1/1942 | Dickieson, Jr. | 62/503 |
| 2,393,854 | 1/1946 | Carpenter | 62/513 |
| 2,467,078 | 4/1949 | Cahenzli, Jr. | 62/503 |
| 2,472,729 | 6/1949 | Sidell | 62/503 |
| 2,530,648 | 11/1950 | Cahenzli, Jr. et al. | 62/503 |
| 3,021,693 | 2/1962 | Aune | 62/513 |
| 3,621,673 | 11/1971 | Foust | 62/503 |
| 3,651,657 | 3/1972 | Bottum | 62/503 |
| 3,765,192 | 10/1973 | Root | 62/503 |
| 3,872,687 | 3/1975 | Bottum et al. | 62/503 |

*Primary Examiner*—Ronald C. Capossela
*Attorney, Agent, or Firm*—Albert L. Jeffers

[57] ABSTRACT

A heat exchanger in a suction accumulator for the compressor of a refrigeration system wherein the suction accumulator comprises a storage vessel having a liquid and gaseous refrigerant inlet, and means within the vessel defining a fluid passageway for separating the gaseous and liquid components and conducting the gaseous component and a controlled amount of liquid out of the storage vessel to the inlet of the compressor. This fluid passageway may comprise a generally U-shaped conduit or, alternatively, a U-shaped flume formed by a vertical weir member. The heat exchanger comprises a jacket disposed over at least a portion of the surface of the gaseous refrigerant conduit or weir member and is spaced therefrom so as to form a second fluid passageway, which is sealed from the gaseous refrigerant passageway and the interior of the vessel. An inlet and outlet lead from the second fluid passageway out of the storage vessel.

15 Claims, 10 Drawing Figures

SUCTION ACCUMULATOR HAVING HEAT EXCHANGER

BACKGROUND OF THE INVENTION

The present invention relates to a heat exchanger within a suction accumulator particularly adapted for use in a refrigeration system.

Most compressors used in refrigeration systems are designed for the compression of gaseous refrigerant. Under some circumstances, however, a certain amount of liquid may flow from the evaporator into the inlet of the compressor so as to cause a condition known as slugging. If this occurs after the system is shut down, large quantities of condensed refrigerant return through the suction line to the crankcase of the compressor, and when the compressor is restarted, the large quantity of liquid refrigerant present therein results in abnormally high pressures which frequently causes blown gaskets, broken valves, and the like.

Suction accumulators prevent this from occurring by providing a reservoir for the liquid refrigerant at the inlet to the compressor, and serve to separate the gaseous and liquid components of the refrigerant so that only the gaseous component and a controlled amount of liquid is admitted to the inlet of the compressor. One type of accumulator comprises a vessel having a generally U-shaped tube mounted therein, wherein one end of the tube is connected to an outlet tube leading from the vessel, and the other end of which is open to the interior of the vessel. As the incoming liquid refrigerant flows into the vessel, it collects in the bottom thereof whereas the gaseous component is carried off through the tube to the outlet. This type of suction accumulator is disclosed in U.S. Pat. No. 3,420,071, for example.

Another type of suction accumulator comprises a storage vessel having a generally vertical weir member located between the vessel inlet and outlet and which forms, in conjunction with the confronting walls of the vessel, a storage reservoir and an outlet flume on opposite sides of the weir. The vessel fluid inlet is located on the reservoir side of the weir member and the fluid outlet on the flume side thereof. This type of accumulator is disclosed in U.S. Pat. No. 4,041,728.

In order to improve the efficiency of refrigeration systems, it has been found desirable to cool the refrigerant leaving the condenser prior to its entering the high pressure side of the evaporator. In order to accomplish this, the prior art teaches providing a heat exchanger coil within the suction accumulator so that the relatively warm refrigerant from the condenser can be cooled through heat exchange with the relatively cool liquid refrigerant in the accumulator. In most cases, the heat exchanger simply comprises a coil disposed within the accumulator. In other cases the coil is in close proximity or in contact with the gaseous refrigerant tube, or mounted in a more remote location. Such an arrangement results in an inefficient transfer of heat between the respective fluids, and causes manufacturing problems. Prior art patents disclosing such heat exchangers include U.S. Pat. Nos. 2,393,854, 2,467,078, 2,472,729, 2,530,648, 3,021,693, 2,270,934, and 3,765,192.

SUMMARY OF THE INVENTION

The suction accumulator heat exchanger of the present invention overcomes the disadvantages of the prior art by virtue of the fact that the heat exchange fluid passageway is formed as a jacket around at least a portion of the gaseous refrigerant passageway, thereby resulting in optimum heat exchange between the respective fluids. In one embodiment of the invention, the heat exchange passageway is formed as an annular passageway around the U-shaped gaseous refrigerant conduit. In another embodiment, the heat exchange passageway is formed within the weir member, which divides the vessel into the storage and outlet flume portions. In the latter embodiment, easily manufactured and assembled metal stampings can be utilized for the weir-heat exchanger.

The advantage of arrangement described above is that the refrigerant flowing through the heat exchange passageway comes into direct heat exchange contact both with the incoming liquid and the gaseous refrigerant within the storage portion of the vessel, and with the gaseous refrigerant flowing through the outlet flume or U-shaped tube, as the case may be. As opposed to many prior art heat exchangers which are disposed within the lower portion of the accumulator so that they are submersed in the relatively placid liquid refrigerant, the heat exchanger of the present invention is always subjected to moving refrigerant, either gaseous or liquid.

Specifically, the present invention relates to a heat exchanger integrated with a suction accumulator including a storage vessel having a refrigerant inlet, and means defining a first fluid passageway in the vessel having an inlet in communication with the interior of the vessel and an outlet extending out of the vessel. The heat exchanger comprises a jacket disposed over at least a portion of the surface of the means defining a first fluid passageway and being spaced therefrom so as to form a second fluid passageway between the jacket and the surface. The second fluid passageway is sealed from a first passageway and from the interior of the vessel and has a fluid inlet and a fluid outlet each leading to the exterior of the vessel.

It is an object of the present invention to provide a suction accumulator having a heat exchanger wherein the heat exchange passageway is formed as a jacket around at least a portion of the gaseous refrigerant passageway within the accumulator vessel.

It is a further object of the present invention to provide a suction accumulator heat exchanger wherein the refrigerant flowing through the heat exchanger comes into direct heat exchange contact both with the incoming liquid and gaseous refrigerant and with the gaseous refrigerant flowing through the gas-liquid separation flume or conduit.

A still further object of the present invention is to provide a suction accumulator heat exchanger which is simple in design and economical to manufacture.

These and other objects of the present invention will become more apparent from the detailed description together with the accompanying drawings.

DETAILED DESCRIPTION

Figure 1:
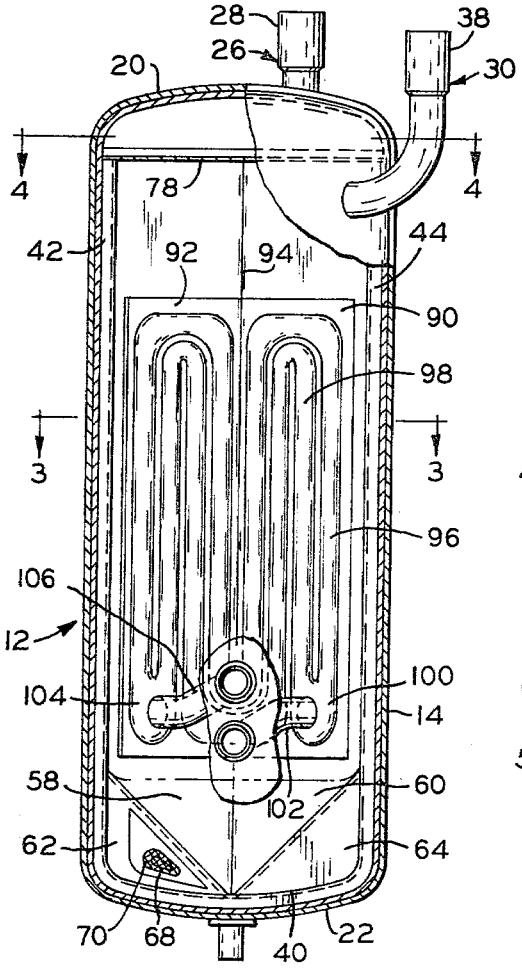
FIG. 1 is a partially sectioned elevational view of one embodiment of the suction accumulator and heat exchanger according to the present invention.
Figure 2:
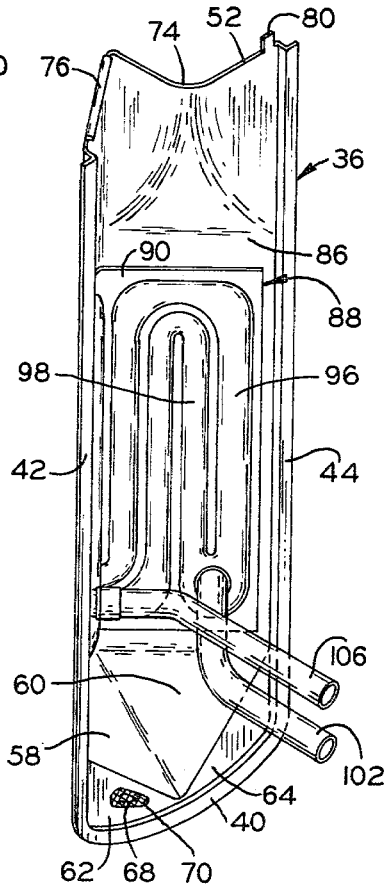
FIG. 2 is a perspective view of the weir member of the suction accumulator and heat exchanger of FIG. 1.
Figure 3:
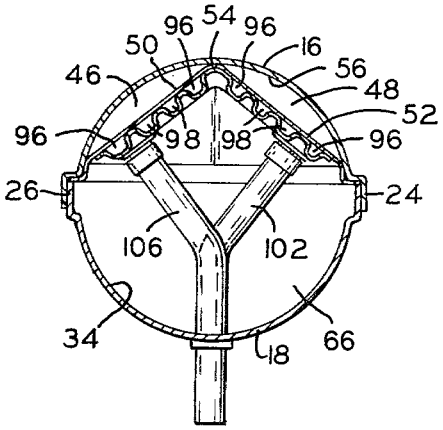
FIG. 3 is a sectional view taken along line 3—3 of FIG. 1.
Figure 4:
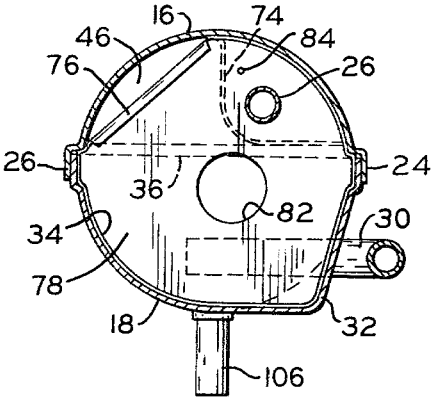
FIG. 4 is a sectional view taken along line 4—4 of FIG. 1.
Figure 5:
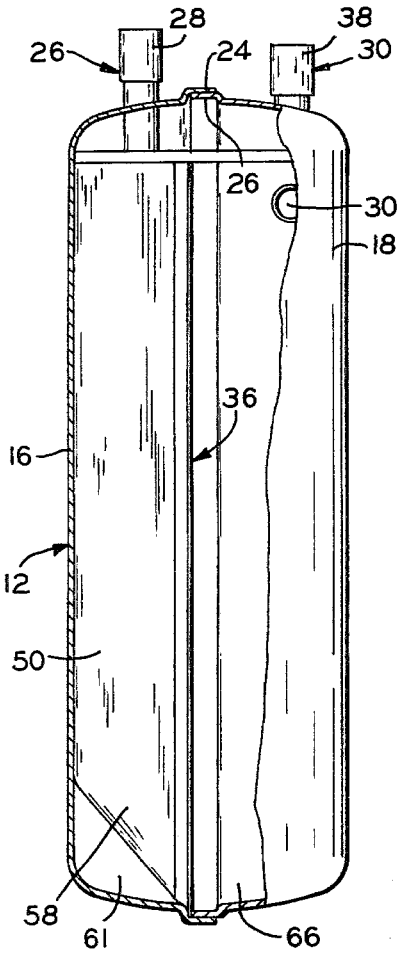
FIG. 5 is an elevational view of the suction accumulator and heat exchanger with portions of the outer vessel cut away.

With reference to FIGS. 1-4, suction accumulator 12 comprises a pressure vessel 14, which is preferably formed of two identical half sections 16 and 18 produced from sheet metal by a stamping process. Vessel 14 has a generally cylindrical midsection with convex top 20 and bottom 22 ends. Preferably, sections 16 and 18 are joined together by overlapping seams 24 and 26, which are copper brazed in a hydrogen atmosphere furnace, thereby creating a strong, fluid tight seam. It should be noted that the seams 24 and 26 extend lengthwise of the vessel 14 and lie within a plane coinciding with the longitudinal axis of the vessel, which is preferably vertically disposed when the suction accumulator 12 is installed.

A vertically disposed outlet pipe fitting 26 is sealed in an extrusion-pierced, collared aperture in the top portion of vessel section 16, with the outer end 28 thereof being enlarged to form the female member of a sweat connection with the suction line of a mechanical compressor (not shown). Inlet fitting 30 is also received within an extrusion-pierced, collared aperture extending through a bulbous portion 32 of vessel wall section 18, and is horizontally disposed and tangentially positioned with respect to the arcuate inner surface 34 of vessel section vessel section 18. This is so that the incoming refrigerant will impinge on a surface which is shaped to cause the fluid to flow round the vessel axis with a swirling motion. This swirling motion causes the liquid refrigerant to flow to the lower portion of the accumulator and the gaseous component to flow upwardly, thereby providing improved gas-liquid separation. Furthermore, as the refrigerant flows around surface 34, it will impinge on weir member 36, which contains the heat exchanger, as will be described in greater detail below. It will be appreciated that by having the incoming refrigerant from the evaporator impinge on the heat exchanger containing weir member 36 prior to settling in the lower portion of vessel 14, improved heat transfer between it and the liquid flowing through the heat exchanger is realized. The outer end 38 of inlet fitting 30 is enlarged to form the female member of a sweat connection with the compressor return line from the refrigerant evaporator.

Weir member 36 is a non-planar sheet metal plate formed by a stamping process, and is so formed that when it is positioned vertically within vessel 14, its bottom edge 40 and side edges 42 and 44 sealingly attach to the inner surface of the vessel as by copper brazing. Preferably, weir member 36 is wholly contained within one side section 16 of vessel 14, and is shaped such that a generally U-shaped outlet flume having two upright passageways 46 and 48 are formed between it and vessel section 16. Passageways 46 and 48 are formed by two generally planar rectangular panel sections 50 and 52 integrally connected together along a vertical ridge 54 which abuts the vessel wall 56. Panel sections 50 and 52 terminate above the bottom end of the vessel but have integrally connected triangular panel extensions 58 and 60 which are angled away from the vessel wall and integrally joined together in the shape of a half pyramid. Two coplanar wing sections 62 and 64, depending from panel extensions 58 and 60, span the spaces between the lower ends of the panel extensions 58 and 60 and the adjacent wall of vessel half section 16. The wing sections 62 and 64 and panel extensions 58 and 60 jointly define the inner wall of the connecting leg 61 of the U-shaped outlet flume.

In addition to defining the outlet flume, weir member 36 also defines storage reservoir 66, which is formed between weir member 36 and the inner wall 34 of vessel half section 18.

A liquid bleed-through aperture 68 having a diameter of 1/16", for example, is located at the bottom end of weir member 36 in wing section 62. Preferably, aperture 68 and the area around it is recessed away from the reservoir 66 so that when a screen 70 is welded over the recessed area, a plurality of screen openings are available to the recessed area and will prevent clogging of the fluid path leading from one side of weir member 36 to the other.

The top portion 72 of outlet flume leg 48 is enlarged by forming a bulbous section 74, which extends under and slightly beyond the vertically disposed outlet fitting 26. Preferably, this bulbous section 74 is streamlined as much as possible so that the incoming refrigerant liquid does not splash excessively in a vertical direction either upwardly or downwardly. The top of panel 50 defining the inlet leg 46 of the flume has a narrow lip 76 which extends over an edge of a horizontally disposed baffle plate 78. A vertically projecting twist tab 80 is provided on the top edge of outlet leg panel 52 to locate and hold baffle plate 78 in position on weir member 36 during assembly.

Baffle plate 78 is shaped to conform to the cross sectional shape of the inside of vessel 14 level with the top of weir member 36 but excluding the area over the top of the inlet leg 46 of the flume which is left open. A large diameter opening 82 adjacent the center of baffle plate 78 forms the primary fluid outlet from the reservoir 66 to the flume inlet leg 46. Preferably, this opening is not centered on the vessel axis but is offset towards the inlet fitting 30 so that the entire opening is upstream from the inlet to reservoir 66. The area of opening 82 as well as the cross sectional areas of the outlet flume are sized so that they are all larger than the area of the vessel inlet or outlet. A second aperture 84 extends through baffle plate 78 for the purposes of pressure equalization. Up to this point, the suction accumulator 12 described is identical to that disclosed in U.S. Pat. No. 4,041,728.

The heat exchanger according to the present invention is formed against one side 86 of weir member 36 and comprises a non-planar sheet metal stamping, which is generally in the shape of an angled piece of sheet metal 88 having raised portions, which define the tortuous fluid passageways for the liquid refrigerant flowing therethrough. More specifically, sections 90 and 92 lie in respective planes which intersect along the fold line 94. Ridges 96 and 98, which extend from one edge of section 90 to the opposite edge of section 92, form a pair of generally parallel, tortuous fluid passage ways leading from the raised manifold 100 in communication with inlet 102 to the raised manifold 104 in communication with outlet 106. The planar portions of sections 90 and 92 and the respectively coplanar portions between raised ridges 96 and 98 are copper brazed against the facing side of weir member 36. Inlet 102 and outlet 106 extend through half section 18 for connection to the condenser outlet (not shown) and evaporator inlet (not shown), respectively.

When suction accumulator 12 is connected in a refrigerant compressing-evaporating system between the compressor and evaporator, the incoming refrigerant liquid, which may be substantially liquid, substantially gaseous, or a mixture of liquid and gas including some lubricating oil, enters vessel 14 through the tangentially disposed inlet fitting 30 at the top of the reservoir 66 immediately beneath the baffle plate 78.

The incoming refrigerant is projected against the confronting cylindrical surface 34 of the vessel 14 and caused to flow around the vessel in a generally circular or helical path, past the angularly disposed weir plate 36 and the similarly angularly disposed heat exchanger surface 88, and around the remaining cylindrical section of the vessel 14. The swirling action of the liquid-gaseous refrigerant creates a vortex in the reservoir 66 and slings the heavier liquid portion of the refrigerant toward the outer wall of the reservoir 66 away from the vicinity of the opening 88 in baffle 78. The lighter, relatively dry refrigerant gas in the vortex area is free to pass out of the reservoir 66 via opening 82 and enter the upper chamber of the accumulator 12 with a minimum of pressure drop. The liquid is temporarily retained in reservoir 66 as the gaseous portion flows out through the opening 82, then over the top of weir member 36 down flume inlet leg 46, across connecting leg 61, up flume outlet leg 48 and then vertically out of the vessel 14 through outlet fitting 28.

As the gaseous refrigerant follows this course, it first contacts the confronting side 88 of the heat exchanger while it is in the reservoir 66, and then contacts panel sections 50 and 52 and triangular extensions 58 and 60 of weir member 36, as it flows through the outlet flume. It will be appreciated that the panel sections 50 and 52 of weir member 36 form the rear walls for the heat exchange passageways. This arrangement permits the gaseous component of the refrigerant to come into direct heat exchange contact with the refrigerant flowing through the heat exchanger on both sides of weir member 36.

Since the compressor lubricant entrained in the liquid or gaseous refrigerant entering accumulator 12 tends to collect as a liquid in the bottom of reservoir 66, the metering aperture 68 in conjunction with the pressure differential existing between the reservoir 66 and the outlet flume induces a metered flow of liquid lubricant into the gaseous refrigerant stream flowing through the flume, thereby ensuring that the lubricant is continually fed from the accumulator 12 to the compressor.

As mentioned previously, the heat exchange inlet 102 connects to the condenser outlet, and the heat exchange outlet 106 connects to the inlet of the evaporator. The refrigerant flowing through the heat exchanger, which, as it will be noted, flows against the flow of incoming refrigerant to the suction accumulator 12, will be cooled. Additionally, the refrigerant flowing through the accumulator 12 will be heated, thereby resulting in more efficient operation of the compressor.

Referring now to FIGS. 6–10, a modified form of the suction accumulator and heat exchanger of the present invention will be described.

The accumulator 108 comprises a vessel 110 having a cylindrical midsection 112 and end caps 114 and 116, the latter having a mounting lug 118. Refrigerant inlet fitting 120 and outlet fitting 122 are received in suitably dimensioned openings in upper end cap 114 and are copper brazed thereto. Baffle plate 124 is brazed to midsection 112 and is cut away to form a pair of arcuate spaces 126 and 128 between it and the inner wall 130 of vessel midsection 112. A raised ridge 132 serves to deflect the incoming refrigerant from inlet fitting 120 toward the inner wall 130 of vessel midsection 112 and toward openings 126 and 128.

Figure 6:
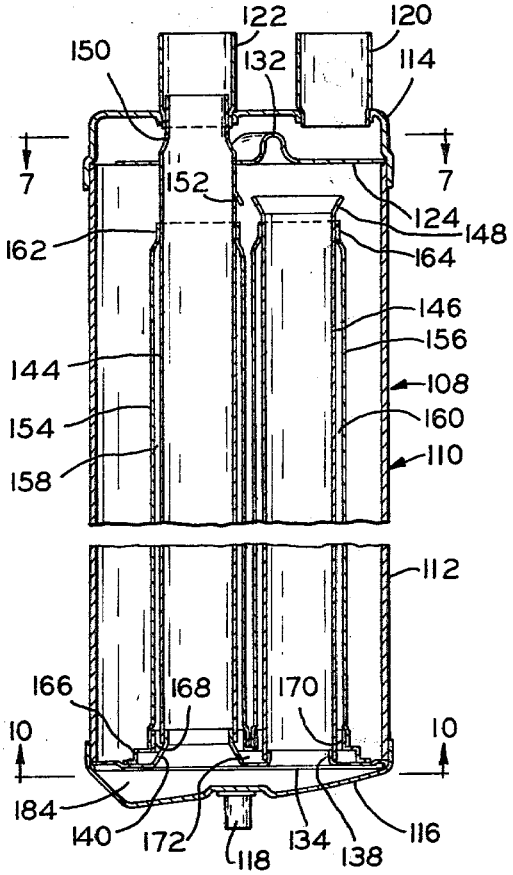
FIG. 6 is a longitudinal sectional view of a second embodiment of the invention.
Figure 7:
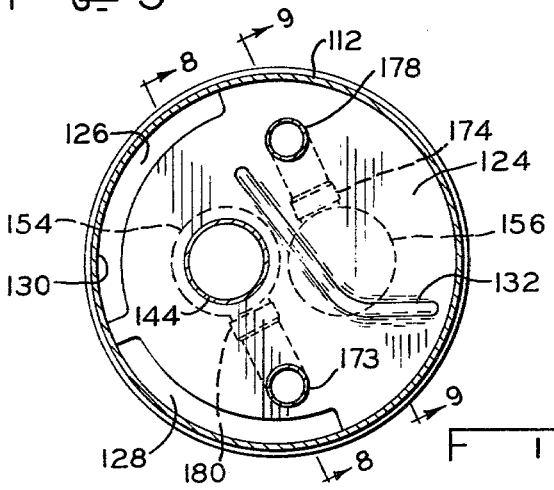
FIG. 7 is a transverse sectional view taken along line 7—7 of FIG. 6.
Figure 8:
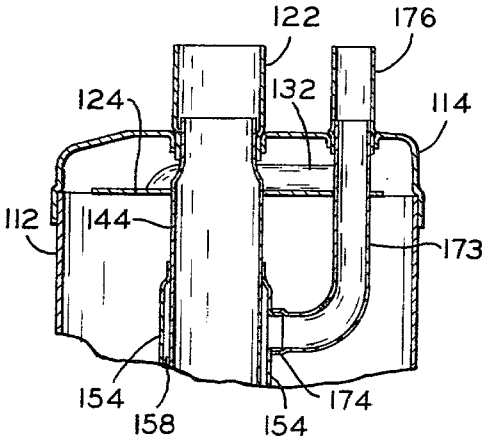
FIG. 8 is a fragmentary sectional view taken along line 8—8 of FIG. 7.
Figure 9:
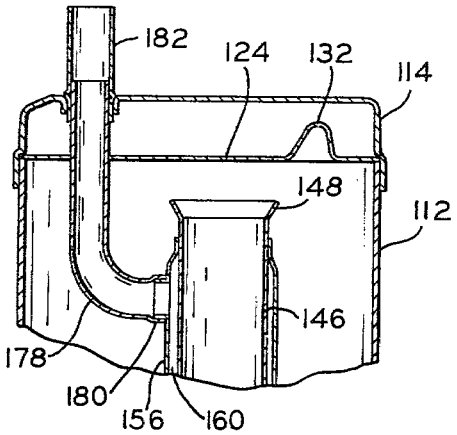
FIG. 9 is a fragmentary sectional view taken along line 9—9 of FIG. 7.
Figure 10:
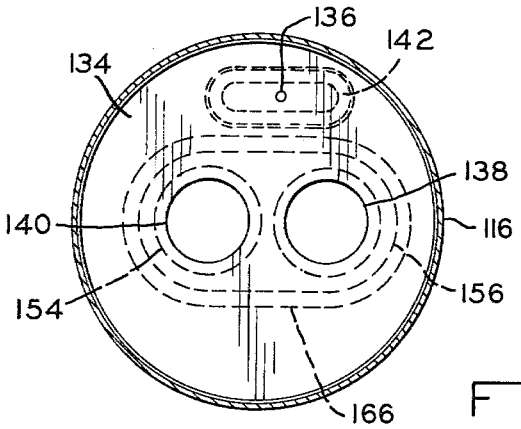
FIG. 10 is a sectional view taken along line 10—10 of FIG. 6.

Received within the lower portion of vessel 110 and brazed to vessel midsection 112 is a partition member 134 having a bleed-through orifice 136 formed therein. Also formed in partition member 134 are a pair of pierced and drawn openings 138 and 140, which extend upwardly as shown in FIG. 6. A screen 142 is welded to partition member 124 and prevents bleed-through orifice 136 from becoming clogged.

A pair of vertically oriented tubes 144 and 146 are positioned around and brazed to drawn openings 140 and 138, respectively. Inlet tube 146 has a flared top 148, and the top 150 of tube 144 is drawn down so that it may be snugly received within outlet fitting 122. An opening 152 in tube 144 provides for pressure equalization between tube 144 and the interior of vessel 110.

The heat exchanger of this embodiment of the invention is formed by a pair of tubes 154 and 156 concentrically positioned around tubes 144 and 146, respectively, such that a pair of annular passageways 158 and 160 are formed therebetween. The upper ends 162 and 164 of tubes 154 and 156 are drawn down into snug engagement with tubes 144 and 146 and brazed thereto. A flange member 166 having openings 168 and 170 is brazed to partition member 134 and to the lower ends of outer tubes 154 and 156. It will be noted that a pass over duct 172 is formed between annular heat exchange passageways 158 and 160. Thus, a completely sealed heat exchange passageway is formed between the suction accumulator tubes 144 and 146 and partition member 134 and outer tubes 154 and 156 and flange member 166.

An inlet tube 173 is brazed to an appropriate fitting portion 174 on tube 154 and is also brazed at its other end to inlet fitting 176. In a similar fashion, the outlet tube 178 for the heat exchanger is brazed to a fitting portion 180 on tube 156 and is brazed at its other end to heat exchange outlet fitting 182. As can be seen, the heat exchange system is completely sealed from the accumulator system so that no intermixing of fluids is possible.

As the incoming liquid-gas refrigerant flows into accumulator 108 through inlet fitting 120, it strikes baffle plate 124 and is deflected outwardly toward openings 126 and 128 by ridge 132. It drops down through openings 126 and 128 and continues to flow in a swirling motion around the midsection 112 of vessel 110, with the liquid refrigerant accumulating in the lower portion of vessel 110 and the gaseous, lighter refrigerant rising. As was the case with the previous embodiment, the swirling motion imparted to the incoming refrigerant improves the liquid-gas separation. The gaseous refrigerant rises and passes into tube 146 whereupon it flows downwardly into the manifold 184 formed between partition member 134 and end cap 116. After picking up the proper amount of lubricant, which flows into manifold 184 through bleed-through orifice 136, the gaseous refrigerant flows upwardly through tube 144 and out outlet fitting 122.

The heat exchange refrigerant from the outlet of the condenser (not shown) flows in through inlet fitting 176 through tube 173 into the annular passageway 158 formed between tubes 154 and 144. It flows downwardly into the space between partition member 134 and flange member 166, across duct 172, and upwardly through the annular passageway 160 formed between tubes 146 and 156. From there it flows out through tube 178 and outlet fitting 182 to the inlet of the evaporator (not shown). As can be seen, the heat exchange liquid flows in the opposite direction of the flow of gaseous refrigerant in the suction accumulator. This results in the most efficient transfer of heat from the refrigerant in the suction accumulator system to the refrigerant in the closed heat exchange system.

While this invention has been described as having a preferred design, it will be understood that it is capable of further modification. This application is, therefore, intended to cover any variations, uses, or adaptations of the invention following the general principles thereof and including such departures from the present disclosure as come within known or customary practice in the art to which this invention pertains and fall within the limits of the appended claims.

What is claimed is:

1. In a refrigeration system suction accumulator including a storage vessel having a refrigerant inlet, and means defining a first fluid passageway in the vessel having an inlet in communication with the interior of the vessel and an outlet extending out of the vessel, said means defining a fluid passageway having an outer surface within the vessel, jacket means disposed over at least a portion of said surface and being spaced therefrom so as to form a second fluid passageway between said jacket and said surface, said second passageway being sealed from said first passageway and from the interior of said vessel and having an inlet and an outlet located exteriorly of said vessel.

2. The suction accumulator of claim 1 wherein said means defining a first passageway comprises a generally U-shaped tubular structure, and said jacket means comprises a second tubular structure secured to said first tubular structure, and concentric therewith, at least a portion of said second passageway being annular.

3. The suction accumulator of claim 1 wherein said means defining a first passageway comprises a first pair of vertical tubes communicating with each other through a common first manifold, and said jacket means comprises a second pair of tubes concentric with said first tubes, said second passageway comprising a pair of annular passageways between respective ones of said first and second pairs of tubes, said annular passageways communicating with each other through a common second manifold.

4. The suction accumulator of claim 3 wherein said first and second manifolds include a common horizontal partition member separating said manifolds.

5. The suction accumulator of claim 3 wherein said first manifold includes a horizontal partition member separating said first manifold from the rest of the vessel interior, and including a bleed-through orifice extending through said partition member between said first manifold and the rest of the vessel interior.

6. The suction accumulator of claim 1 wherein said means defining a first passageway comprises a vertical weir member, said vessel has first and second wall sections confronting said weir member on opposite sides of said weir member, said weir member forming a reservoir with said first wall section and an outlet flume with said second wall section, said jacket means comprising a wall member positioned over and spaced from said weir member so that said second passageway is formed therebetween.

7. The suction accumulator of claim 6 including baffle means in the space between said weir member and said wall member so that said second passageway is tortuous.

8. In a refrigeration system suction accumulator including a storage vessel, a vertical weir member, said vessel having first and second wall sections confronting said weir member on opposite sides of said weir member, said weir member forming a reservoir with said first confronting wall section on one side of said weir member and an outlet flume with said second confronting wall section on the other side of said weir member, a fluid inlet to the vessel entering said reservoir and a fluid outlet exiting from said flume, the improvement being a heat exchanger comprising: a fluid passageway formed in said weir member between said reservoir and said flume, a fluid inlet leading to said passageway from outside said vessel, and a fluid outlet leading from said passageway to outside said vessel, said passageway being sealed from said reservoir and said flume.

9. The suction accumulator of claim 8 wherein said vessel fluid inlet is oriented to direct a stream of fluid into the reservoir tangentially relative to said first wall section.

10. The suction accumulator of claim 8 wherein said fluid passageway extends throughout nearly all of said weir member.

11. The suction accumulator of claim 8 including baffle means in said fluid passageway confining fluid passing therethrough to follow a tortuous path.

12. The suction accumulator of claim 8 wherein said weir member is made of at least two metal stampings secured together in spaced facing relationship.

13. The suction accumulator of claim 12 wherein one of said stampings comprises a plurality of raised areas which are in contact with the other stamping such that said fluid passageway is tortuous.

14. The suction accumulator of claim 8 wherein said heat exchanger inlet and outlet comprise tubes connected to said weir member and extending through said vessel.

15. In a refrigeration system suction accumulator including a storage vessel having an inlet for liquid and gaseous refrigerant, passageway defining means in said vessel dividing the interior of said vessel into a liquid refrigerant reservoir and a gaseous refrigerant passageway, and an outlet connected to said gaseous refrigerant passageway, the improvement being a heat exchanger comprising: a heat exchange fluid passageway in said vessel within at least a portion of said passageway defining means, one side of said heat exchange passageway being in direct heat exchange contact with said reservoir and the other side of said heat exchange passageway being in direct heat exchange contact with said gaseous refrigerant passageway, said heat exchange passageway being sealed from said reservoir and said gaseous refrigerant passageway, said heat exchange passageway having a fluid inlet and a fluid outlet each leading out of said vessel.

* * * * *